US006101769A

United States Patent [19]

Hamill

[11] Patent Number: 6,101,769

[45] Date of Patent: Aug. 15, 2000

[54] EARTHQUAKE RESISTANT BED

[75] Inventor: James Patrick Hamill, Albuquerque, N. Mex.

[73] Assignee: Survival Technologies International, LLC, Albuquerque, N. Mex.

[21] Appl. No.: 09/120,956

[22] Filed: Jul. 22, 1998

[51] Int. Cl.[7] ..... E04H 9/02

[52] U.S. Cl. ..... 52/167.1; 52/79.4; 52/81.1; 52/81.4; 52/167.4; 5/424; 5/14

[58] Field of Search ..... 52/79.4, 81.1, 52/81.2, 81.4, 167.1, 167.3, 167.4; 5/2.1, 414, 424

[56] References Cited

U.S. PATENT DOCUMENTS

| | | | |
|---|---|---|---|
| 3,851,427 | 12/1974 | Lacoste, III | 52/79.4 |
| 3,916,578 | 11/1975 | Forootan et al. | 52/167.4 |
| 4,069,527 | 1/1978 | Harris . | |
| 4,223,506 | 9/1980 | Blair et al. | 52/167.1 X |
| 4,782,541 | 11/1988 | Tuchman . | |
| 4,798,032 | 1/1989 | Rose, Jr. | 52/81.4 |
| 5,241,717 | 9/1993 | Ward et al. . | |
| 5,354,126 | 10/1994 | Pedrego | 52/167.1 X |
| 5,560,151 | 10/1996 | Roberts | 52/81.1 |
| 5,575,024 | 11/1996 | You . | |
| 5,615,424 | 4/1997 | Nakata . | |
| 5,737,784 | 4/1998 | Jackman | 52/167.4 X |

*Primary Examiner*—Richard Chilcot
*Attorney, Agent, or Firm*—Robert W. Harris

[57] ABSTRACT

A structure for housing a bed, for protection of a sleeper against serious injury or death from damage or collapse of the surrounding residence in an earthquake. The bed protection structure has two kinds of for this purpose: various structural integrity preservation, including means to both enhance the structural strength of the bed protection structure and to also allow the bed protection structure to respond to severe mechanical shocks resulting from impact of parts of the residence structure, while maintaining structural integrity of the bed protection structure; and anti-ballistic penetration, to resist ballistic penetration of residence structure debris fragments into the interior of the bed. The structural integrity preservation include an overall geometry of the form of a modified tetragonal anti-prism or MTAP; triangular spacing of structural members in the MTAP geometry; axially reinforced structural members; and vertical support members containing shock absorbing. The anti-ballistic penetration means include triangular solid panels of composite material. The overall bed protection structure achieves triangulation in all three planes for efficient distribution and resolution of forces, while also providing protection against ballistic penetration of the bed protection structure.

20 Claims, 7 Drawing Sheets

Perspective:Exploded View
Structural Modules

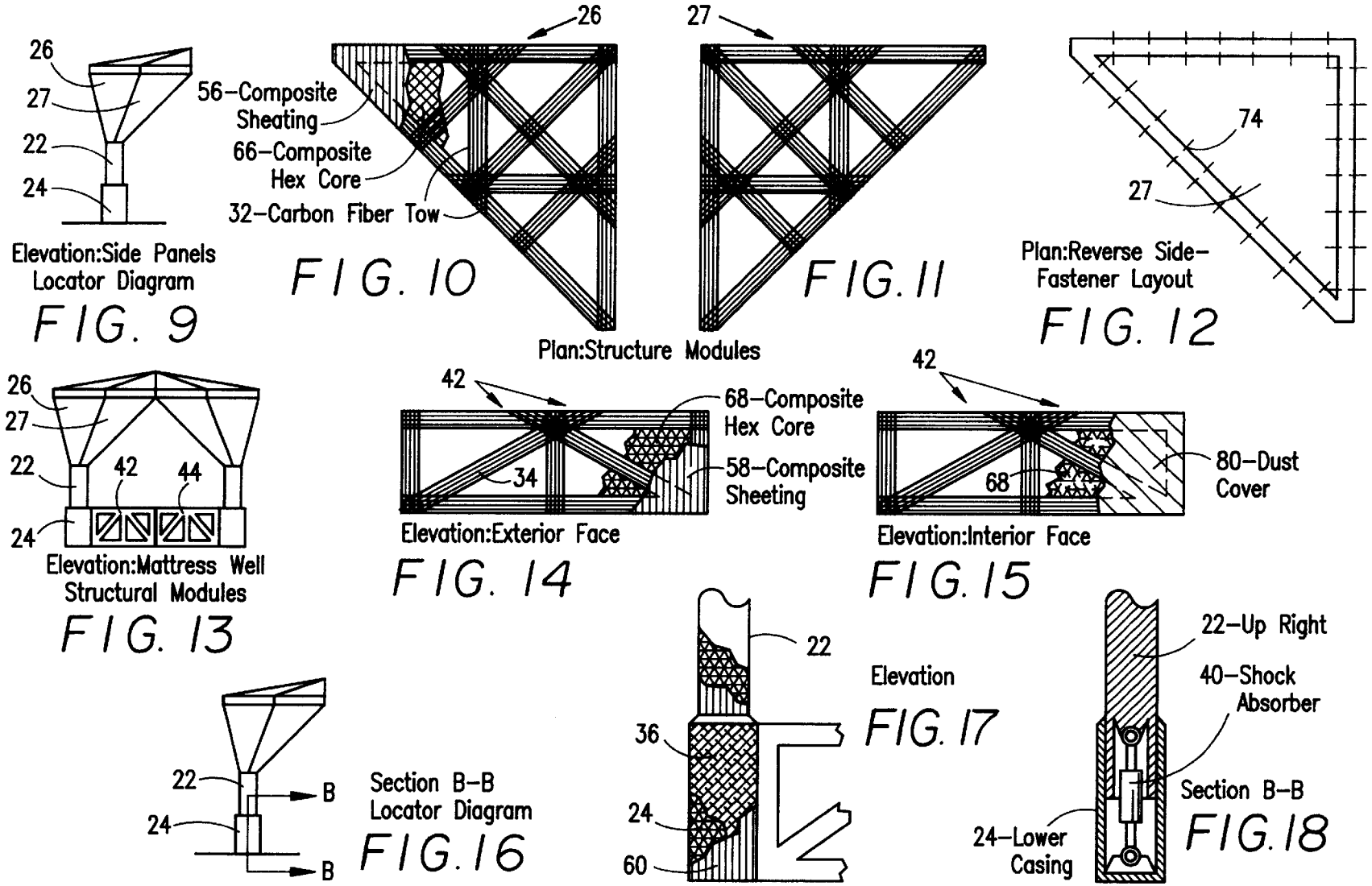
74
27
Plan:Reverse Side-Fastener Layout
FIG. 12
27
FIG. 11
26
56–Composite Sheating
66–Composite Hex Core
32–Carbon Fiber Tow
FIG. 10
Plan:Structure Modules
26
27
22
24
Elevation:Side Panels Locator Diagram
FIG. 9
80–Dust Cover
42
68
Elevation:Interior Face
FIG. 15
68–Composite Hex Core
58–Composite Sheeting
42
34
Elevation:Exterior Face
FIG. 14
26
27
22
24
44
42
Elevation:Mattress Well Structural Modules
FIG. 13
22–Up Right
40–Shock Absorber
Section B–B
24–Lower Casing
FIG. 18
Elevation
FIG. 17
22
36
24
60
Section B–B Locator Diagram
FIG. 16
B
B
22
24

Perspective:Overall Arrangement of Stuctural Modules

SECTION:CC
FIG. 20
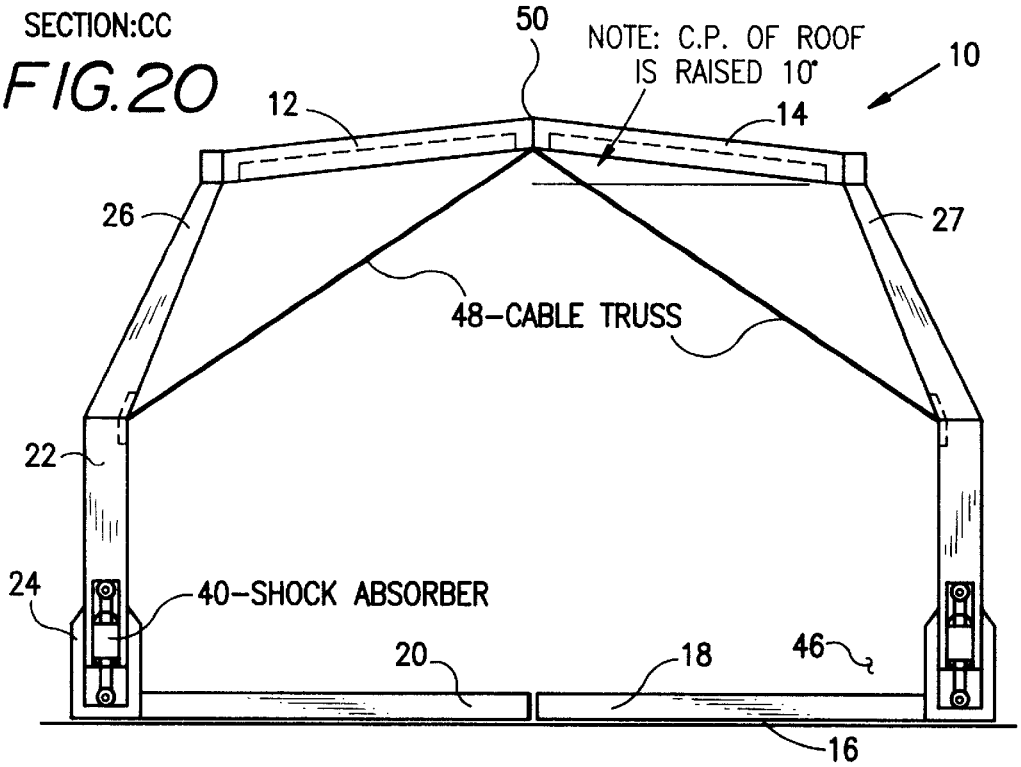
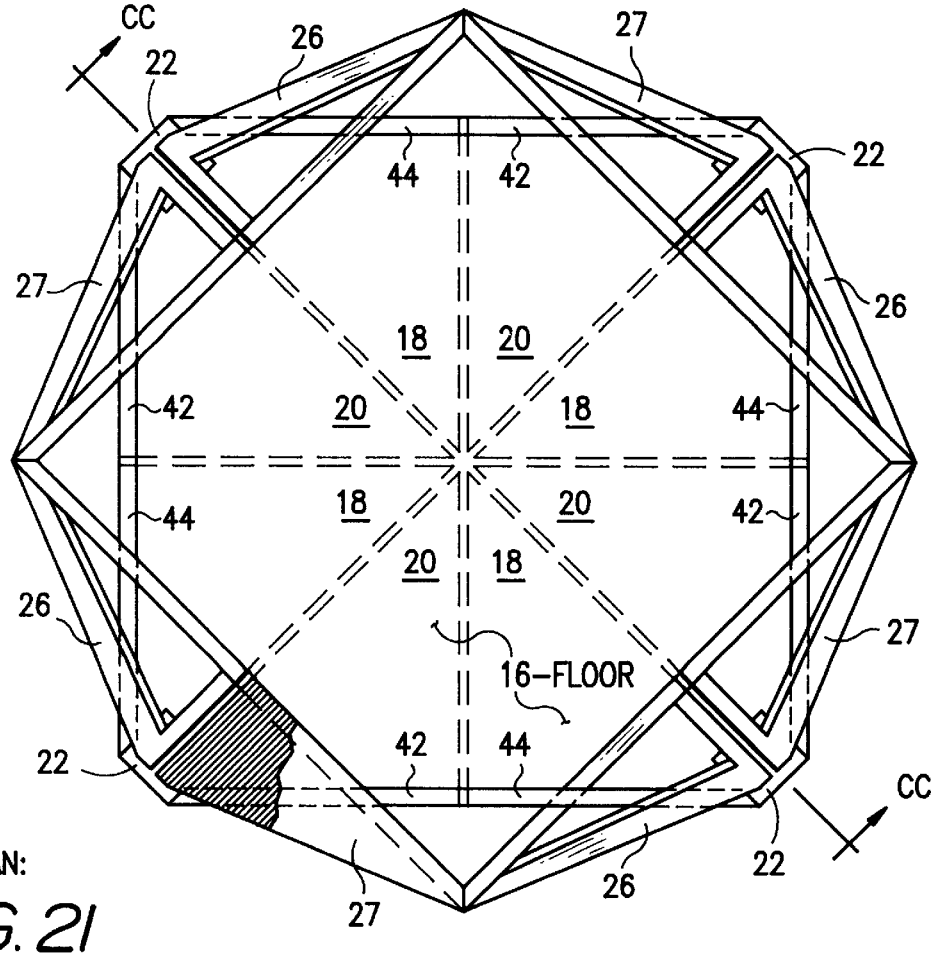
PLAN:
FIG. 21

Perspective:Exploded View
Structural Modules

ELEVATION: STRUCTURAL MODULES
FIG. 23
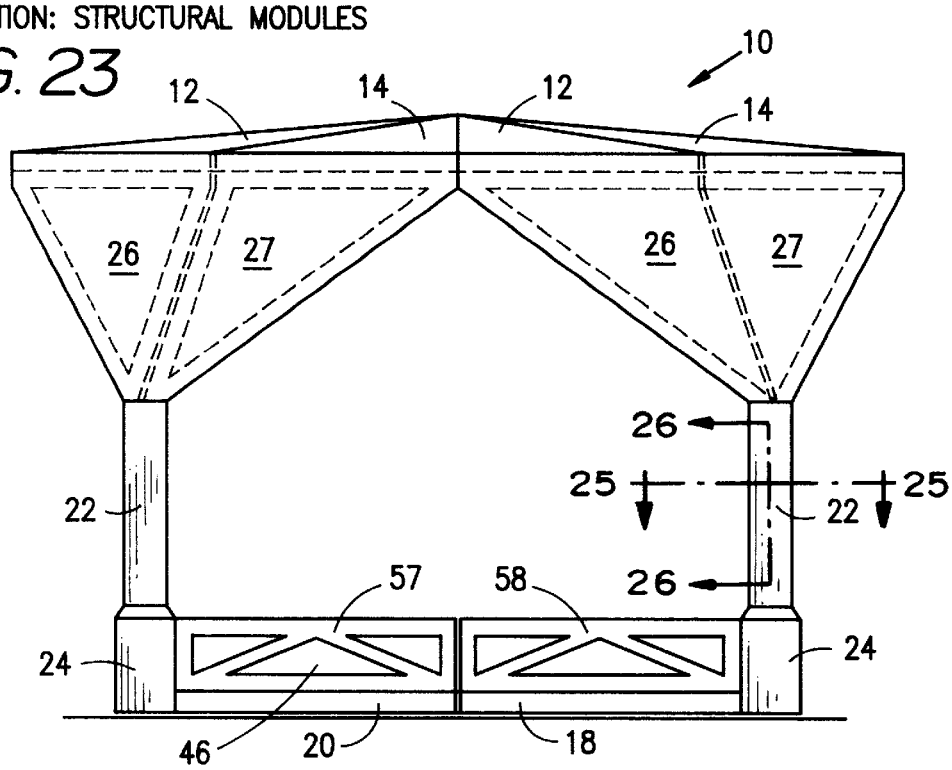
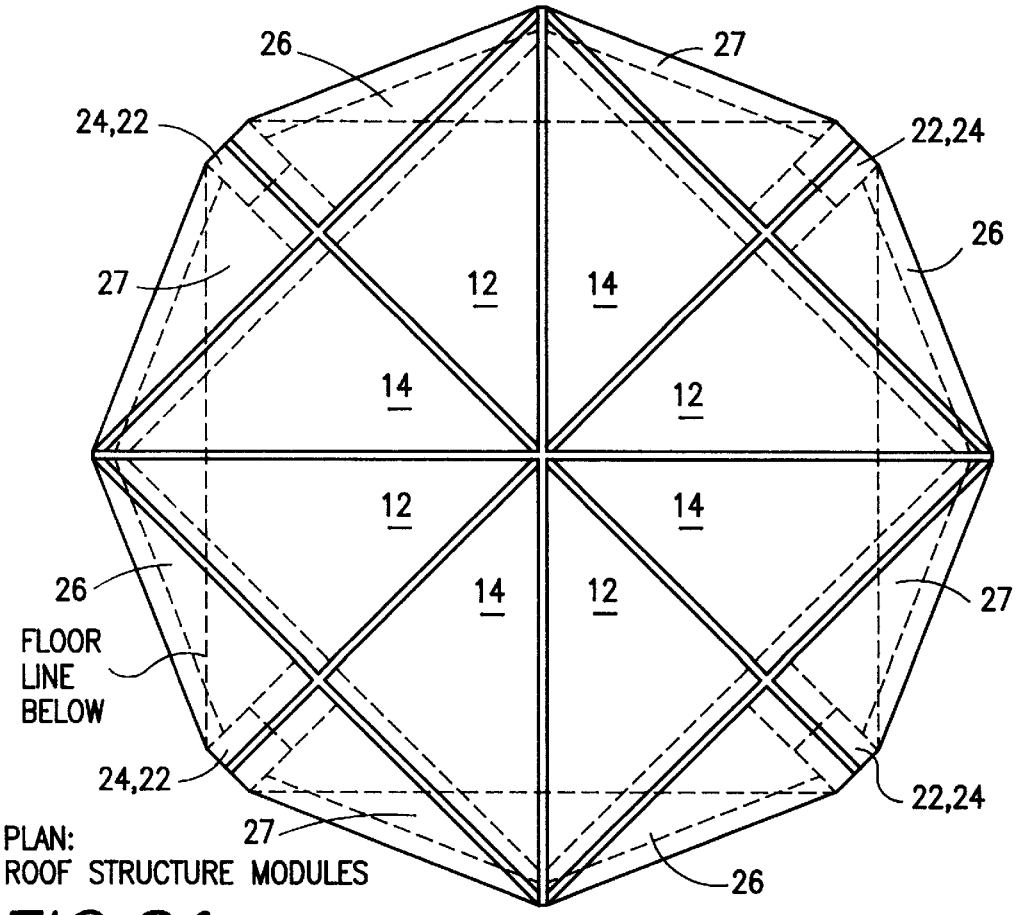
PLAN:
ROOF STRUCTURE MODULES
FIG. 24

EARTHQUAKE RESISTANT BED

BACKGROUND OF THE INVENTION

The invention concerns structures for protection of a sleeper in a bed against serious injury or death which may be caused by the effects of damage to the surrounding residential structure during an earthquake.

Since people spend roughly a third of their lives sleeping, and since severe earthquakes may occur at any time and without any reliable prior warning, there is a need for means to protect a sleeping person against the serious injury or death which may be caused by partial or total collapse of the surrounding residence in which the sleeper's bed is located.

Though many means have been devised for strengthening an entire residential structure against earthquake damage, a bed is a much smaller structure. So it is possible to achieve a higher degree of protection for a sleeper through a protective structure which only surrounds the bed, than may be economically feasible for the entire residence structure, at least for many people of medium or moderate economic means. This is particularly so for persons living in older residences offering inadequate earthquake protection, which may be extremely expensive to retrofit with more adequate structural protective means, for the entire residence. In this connection, an earthquake resistant structure surrounding a bed can not only offer protection for its owner when an earthquake occurs during sleep, but can also provide a ready shelter for the owner to enter even when awake, if there is not sufficient time to exit the building after onset of an earthquake occurring during waking hours.

There are two main kinds of protection which an earthquake resistant bed structure needs to offer, for protection of a sleeper within the structure. First, the protective structure must offer protection against the very large mechanical shocks which may be caused if large pieces of the residential structure fall upon the bed, by redistributing the crash forces in several directions, to dissipate the shock, so as to reduce the likelihood of serious blunt force trauma injury or death for the sleeper.

Second, the protective structure must also offer protection against ballistic penetration of the bed structure by smaller fragments of the residence structure, which fragments may be moving at high velocities, due to the large energy release involved in serious earthquake damage of the residential structure. A single high velocity small structural fragment could cause serious injury or death of the sleeper, even if the protective structure adequately dealt with the large mechanical shocks caused by impact of larger structural debris pieces.

Although prior earthquake bed patents, attached to applicant's Information Disclosure Statement, have disclosed a variety of specific features addressed to providing both of these forms of protection, as detailed in the Information Disclosure Statement, it is the intent of the present invention to provide advantageous combinations of features not afforded or suggested by the prior patents, including certain particular features not disclosed at all in the prior patents, as detailed below and in applicant's Information Disclosure Statement.

SUMMARY OF THE INVENTION

The invention is a structure for housing a bed, for protection of persons therein against injury from damage or collapse of the surrounding primary structure, e.g. a residence, due to an earthquake. The invention structure contains two groups of means for said purpose: various structural integrity preservation means, including means to both enhance the structural strength of the structure and to also allow the structure to respond to severe mechanical shocks and loading resulting from impacts of debris resulting from failure of the primary structure, for tending to preserve structural integrity of the invention structure; and anti-ballistic penetration means, to resist ballistic penetration of the invention structure by debris fragments being thrust against the structure. One structural integrity preservation means, is the use of an overall geometric form for the structure, which is a modified tetragonal anti-prism, hereafter MTAP, with an upper square roof panel surface, having a crowned or slightly elevated center point and sloping downward to the edges of the roof panel, said roof panel having an orientation rotated 90 degrees with respect to a flat bottom square surface, with said roof panel having its vertices joined by slanting structural members to the tops of vertical corner support structural members extending upward from the vertices of the bottom square, at points approximately halfway up the overall structure, so as to form four slanted faces around the upper sides of the structure, which slanting faces are sites for a portion of the anti-ballistic penetration means, as further described below. The structural members have triangular spaces between them, in the top and bottom faces, and side sloping faces, of the overall MTAP structure. The MTAP geometry is believed advantageous for distribution of mechanical shocks and loads impinging upon the structure from varied directions. Another structural integrity preservation means is the use of axially reinforced load bearing structural members, to stiffen said members against bending, each having square, round, or triangular cross section with axial prestressed "cables" fabricated from "tow" synthetics further discussed below. Another structural integrity preservation means, is provided by triangulated tensioned "tow" cables connecting adjacent structural members of the form just described, said "tow" being incorporated in the fill panels. Another structural integrity preservation means, is provided by vertical structural members extending up from the corners of the base of the structure, each containing shock absorber means, for allowing said structural members to shorten under compressive load resulting from primary structure collapse.

One anti-ballistic penetration means is provided by a plurality of triangular, reinforced anti-ballistic panels inserted in the triangular spaces between, and rigidly affixed to, the structural members in the top and bottom and upper sloping faces, of the MTAP structure. Said panels may be composed of composite layers which may include kevlar, spectra, carbon fiber, and tow bundles of parallel strands of high-strength synthetic materials, and may have cores of aluminum, foam, balsa and/or honeycomb cores, which cores may be formed of aluminum, Spectra, or carbon fibers. In addition, open vertical triangular panels of composite material are placed around the sides of the base of the structure, beneath the mattress level. Another anti-ballistic penetration means is provided by the use of exterior sheathing formed of high strength composite materials, which may have a decorative design overlay, over the top, sloping upper sides, and base of the structure, while leaving an adequate opening for a person to enter the bed.

Means are provided for interfacing and joining structural modules, which may be joined by suitable means, including high strength fasteners and/or adhesives.

The preferred embodiment is formed of a plurality of repetitive structural modules for the roof, floor and side panels, to simplify manufacturing and erection of the structure, with each being fabricated as unitary structural modules.

In the preferred embodiment, the structure is fabricated primarily of composite materials, i.e. assemblies of dissimilar non-metallic elements selected to achieve optimum structural strength with minimum weight, except for possible use of metal fastener elements, and possible use of aluminum cores for the anti-ballistic panels. Composite structural members composed of Kevlar, spectra, carbon fibers, and tow bundles may be used, to provide great structural strength while greatly reducing weight as compared to a structure formed, for example, of steel.

The overall MTAP structure optimizes triangulation in all three planes for efficient distribution and resolution of induced forces, as a result of the combined effect of (a) the MTAP geometry; (b) the triangular spacing between structural members and (c) the triangular anti-ballistic panels inserted in the triangular spaces between load bearing structural members.

BRIEF DESCRIPTION OF THE DRAWINGS

In the drawings, which all illustrate the same preferred embodiment:

FIG. 9 is a an elevational view of a portion of the structure showing two side panels.

FIG. 10 is a plan view of the indicated side panel, showing additional details thereof.

FIG. 11 is a plan view of the indicated side panel, showing additional details thereof.

FIG. 12 is a plan view, of the indicated side panel shown in FIG. 11, inverted from the view of FIG. 11.

FIG. 13 is an elevational view of a portion of the structure, showing indicated trusses for protection of the E-Bed mattress well.

FIG. 14 is an elevational view of a portion of the structure showing structural details of indicated structural module, and exterior sheathing.

FIG. 15 is an elevational view of a decorative dust cover on the interior face of indicated module.

FIG. 16 is an elevational view of indicated structural modules which are structural uprights supporting the side panels and roof of the E-Bed.

FIG. 17 is an elevational view showing structural details of indicated modules.

FIG. 18 is a sectional view of the modules shown in FIG. 16, as indicated by the section line B—B of FIG. 16.

FIG. 20 is a sectional view of assembled indicated components, per section line C—C of FIG. 21.

FIG. 21 is a plan view of the assembled indicated structural modules, with the roof structure removed, for clarity.

FIG. 23 is an elevational view of indicated structural modules as assembled in the E-Bed structure.

FIG. 24 is a plan view of indicated modules of the overall assembled E-Bed structure.

DESCRIPTION OF THE PREFERRED EMBODIMENT

Figures 1, 2, 3, 4, 5, 6, 7, 8:
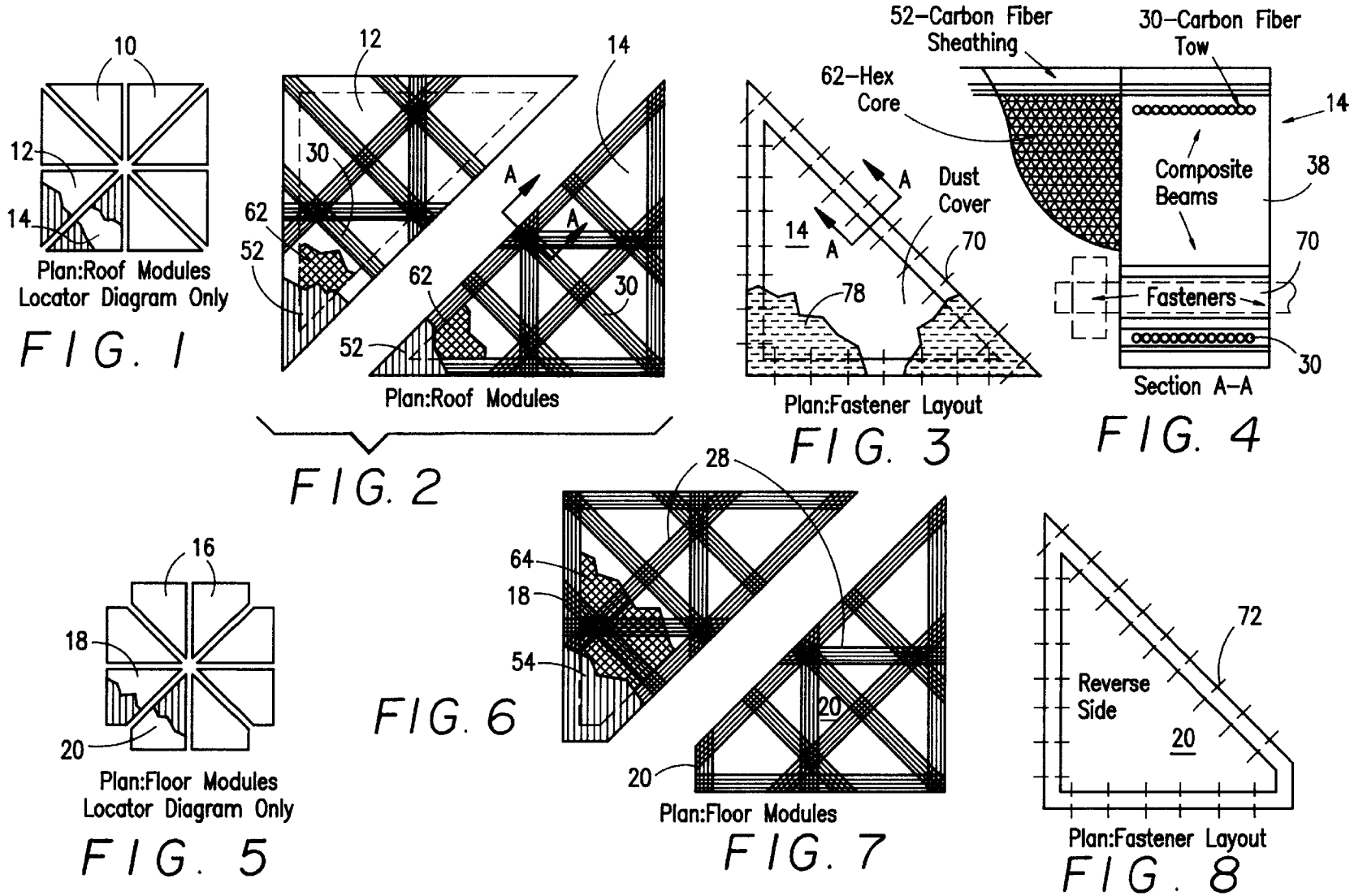
FIG. 1 is a plan view of the roof portion only, of the E-Bed structure.
FIG. 2 is a plan view of two indicated identical roof structural modules, also showing internal structure of same.
FIG. 3 is a plan view of a roof module, inverted.
FIG. 4 is a sectional view of a portion of the module shown in FIG. 3, per the section line A—A of FIG. 3.
FIG. 5 is a plan view of structural modules forming the floor of the structure, showing some additional structure for two indicated modules.
FIG. 6 is a plan view of the indicated floor module, showing additional detail of same.
FIG. 7 is a plan view of another indicated floor module, showing additional detail of same.
FIG. 8 is a plan view of the indicated floor module, inverted, showing additional detail of same.

Referring now to the drawings, in which like reference numbers denote like or corresponding elements, the overall structure of the invention is best shown in FIGS. 19 through 24; while the other drawing figures illustrate various structural elements and modules in more detail, as discussed below. The principal elements of the structure are those comprising the key functional means recited in the above summary: the structural integrity preservation means; and the anti-ballistic penetration means.

The Structural Integrity Preservation Means

Figure 19:
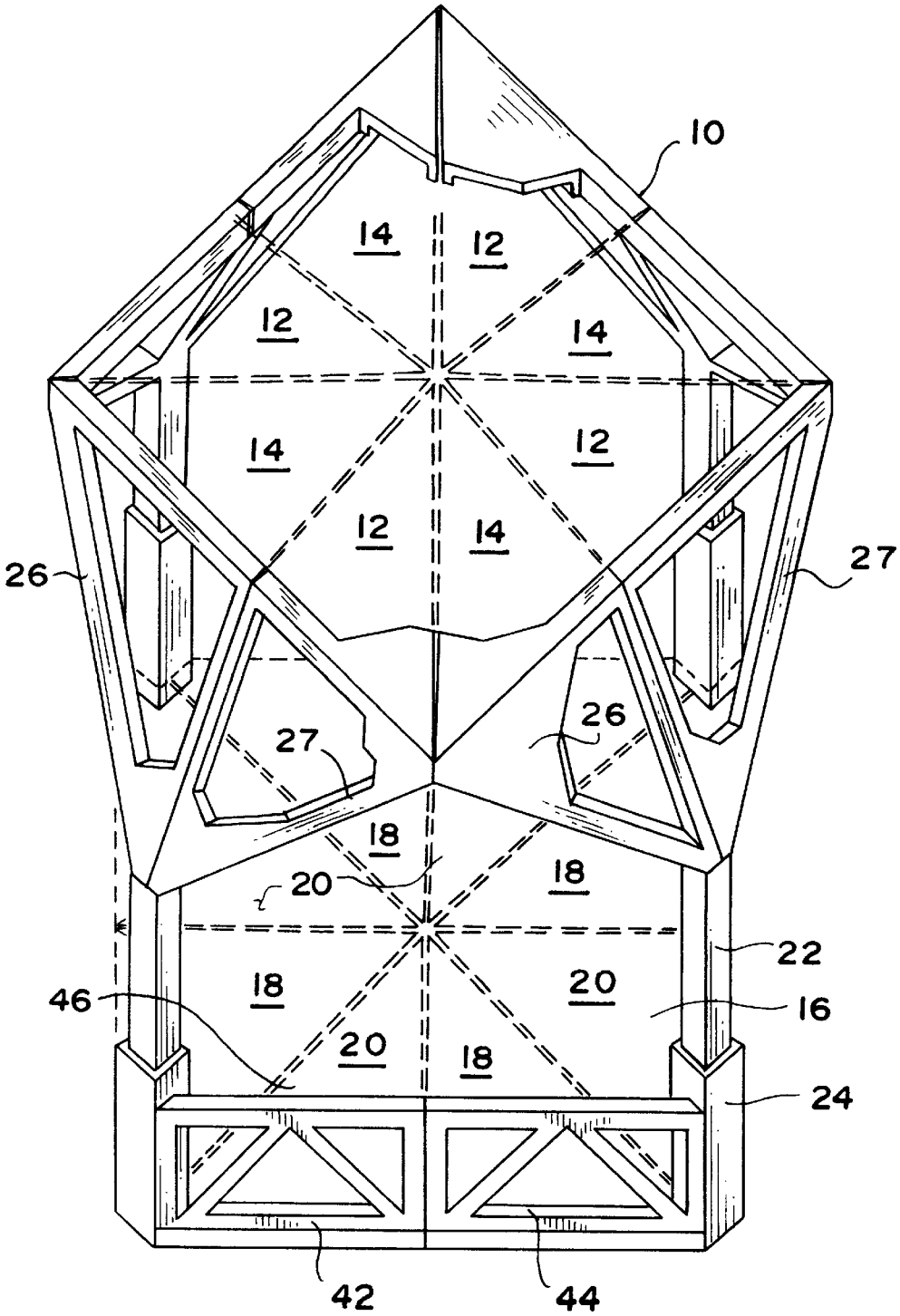
FIG. 19 is a perspective view of indicated structural modules comprising the overall E-Bed structure.
Figure 22:
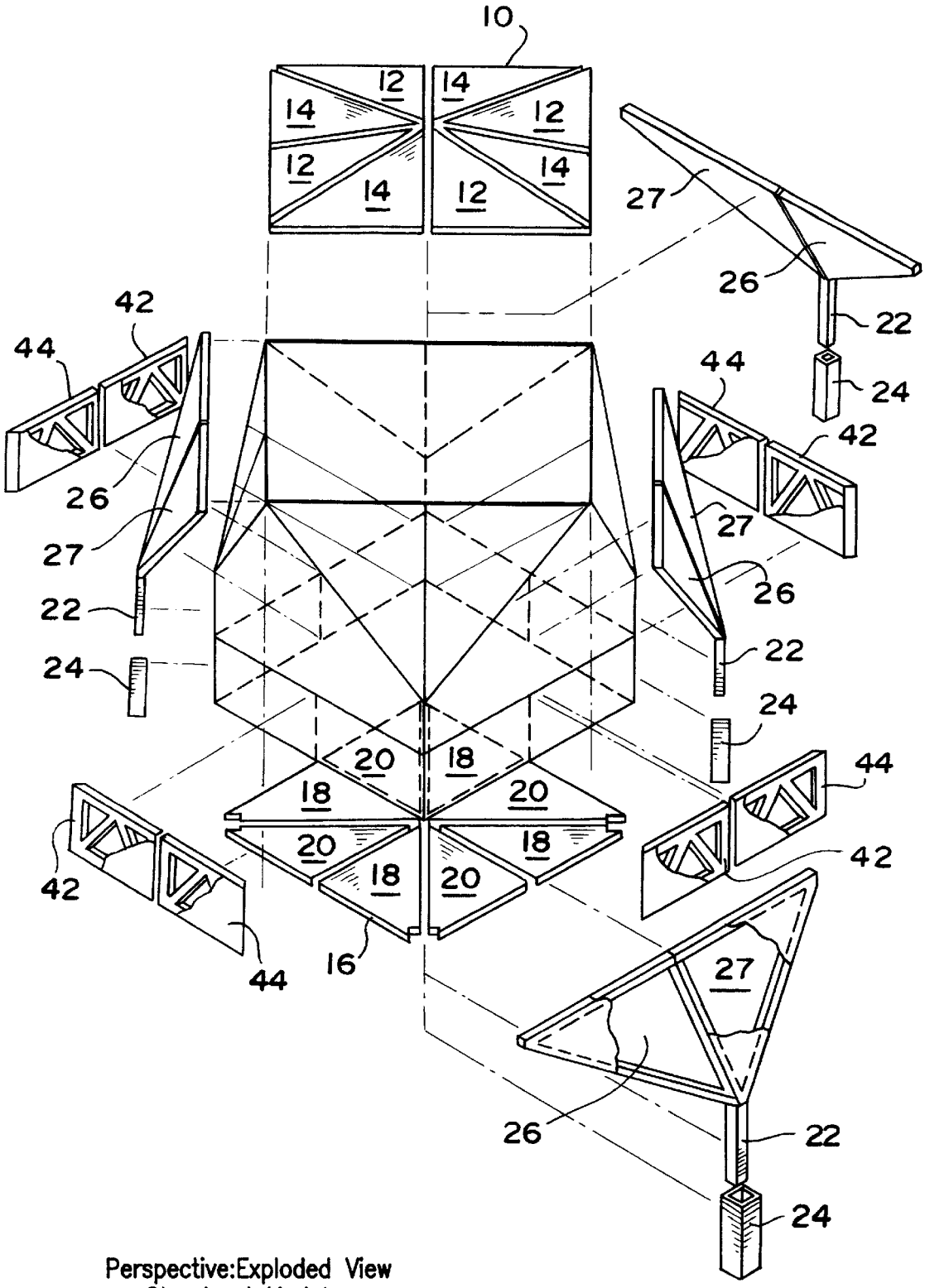
FIG. 22 is an exploded perspective view of indicated structural modules of the E-Bed structure.

One structural integrity preservation means is the MTAP geometry, best seen in FIGS. 19, 21 and 22. In this geometry, the roof 10 of the structure, formed of eight repeated triangular structural modules 12 and 14, is rotated 90 degrees with respect to the structure's floor 16, which floor 16 is formed of eight repeated triangular structural modules 18 and 20; and four identical vertical linear structural members 22, having axial support members 23, said structural members 22 extending upward from within hollow vertical linear structural members 24 secured to the corners of the floor 16, support eight repeating slanting triangular structural modules 26 and 27, extending downward in a slanting orientation from the edges of roof 10. The size of the angle of slant, determined by the roof and base dimensions, is not believed to be critical to the efficacy of the MTAP geometry. The MTAP geometry is believed to enhance structural integrity of the invention by facilitating distribution of stress forces in different planes and directions. Another structural integrity preservation means is the use of the triangular form of structural modules as illustrated in the drawings, which promotes efficient distribution of stress forces in different directions.

Figure 25A:
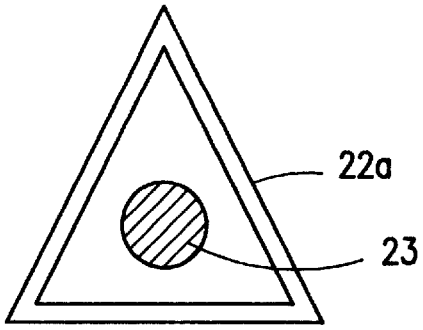
FIGS. 25(*a*), (*b*) and (*c*) are cross sections, on the section line 25—25 of FIG. 23, showing an axial reinforcement member for the indicated vertical structural member, where said vertical structural member is of, alternatively, triangular, square and round cross section, respectively.
Figure 25B:
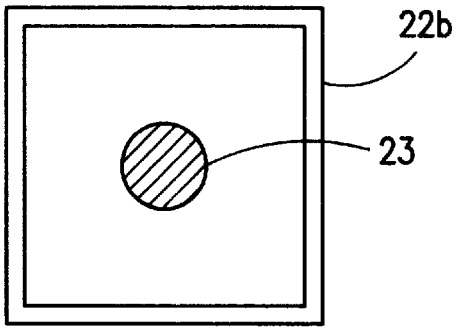
Figure 25C:
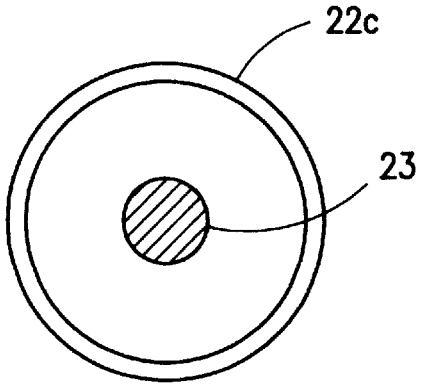
Figure 26:
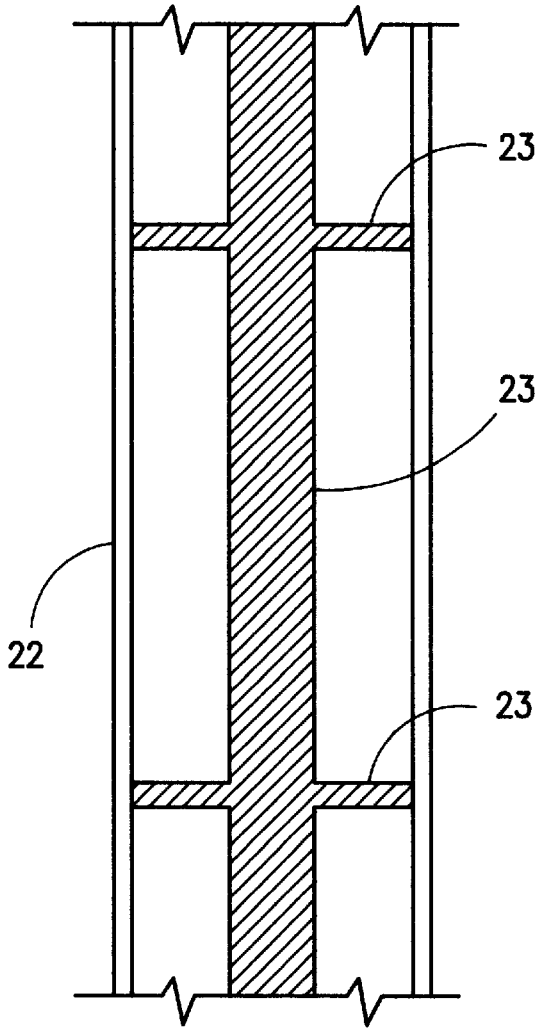
FIG. 26 is a section, on the section line 26—26 of FIG. 23, showing a portion of the indicated vertical structural member and its axial reinforcement member.

Another structural integrity preservation means is provided by load bearing structural members which are axially reinforced to stiffen said members against bending. The axially reinforced structural members may be of square, round or triangular cross sections, preferably triangular. See FIGS. 25 and 26, showing sections indicated by section lines in FIG. 23, of vertical structural members 22 and axial support members 23.

Yet another structural integrity preservation means is provided by the use of triangulated tensioned cables 28 of "tow" material, connecting adjacent axially reinforced linear structural members of the form just described, and comprising a part of anti-ballistic panels inserted between said linear structural members, discussed in more detail below, as shown in FIG. 6, for structural modules 18 and 20. These tow cables are composed of standard tow material formed of parallel bundles of high-strength synthetic materials, such as, for example carbon fiber tow.

Additional tow cables are used in other portions of the structure as a structural integrity preservation means, e.g. tow cables 30, shown in FIGS. 2 and 4; 32, shown in FIG. 10; 34 shown in FIG. 14; and 36, shown in FIG. 17. FIG. 4 also shows additional structure of structural module 14 in a sectional view, per the section line A—A of FIG. 3, FIG. 4 also showing a composite beam 38 constituting the perimeter of the module.

And another structural integrity preservation means, shown in FIG. 18, is provided by shock absorbers 40, contained within the vertical hollow structural members 24, which shock absorbers 40 support the vertical linear structural members 22, and thus allow vertical compressive forces to move structural members 22 downward within structural members 24, compressing and shortening the height of the overall invention structure. The shock absorbers 40 are not limited to any particular kind of shock absorbers; they may be selected as deemed appropriate from varied available forms, offering a wide variety of load capacities and stroke, and may, for example, be air filled, oil filled, or both combined.

An additional structural integrity preservation means is provided by repeating trusses 42 and 44 surrounding and protecting the mattress well 46, shown in FIG. 19.

Another structural integrity preservation means consists of four high strength steel cables 48, shown in FIG. 20, which connect the tops of uprights 22 with the apex 50 of the roof 10.

The Anti-Ballistic Penetration Means

The anti-ballistic penetration means comprises triangular anti-ballistic panels, principally composed of composite materials, said panels comprising the panels formed by repeating modules 12 and 14 which form the roof 10 of the invention's structure, shown in FIG. 1; the sloping side panels comprised of repeating modules 26 and 27, shown e.g. in FIG. 19; and floor panels comprised of repeating floor modules 18 and 20, shown e.g. in FIG. 5. The composites may be layers including one or more members of the group: kevlar, spectra, carbon fiber, and tow bundles of parallel strands of high strength synthetic materials.

Another anti-ballistic penetration means is provided by an external sheathing of composite material, covering at least a major portion of the exterior surface of the structure, said sheathing having sections 52 shown in FIGS. 2 and 4; section 54 shown in FIG. 6; section 56 shown in FIG. 10; section 58 shown in FIG. 14; and section 60 shown in FIG. 17. The composite sheathing material is formed of a laminated combination of material such as carbon fiber, spectra and kevlar, and serves to provide extremely high strength barriers to debris penetration on the top, sides and bottom of the invention structure.

Additional anti-ballistic protection is afforded by use of composite honeycomb structural cores of repeating hexagonal structure throughout the structural modules, e.g. cores 62, shown in FIGS. 2 and 4; 64, shown in FIG. 6; 66, shown in FIG. 10; and 68, shown in FIGS. 14 and 15.

Other Structural Details

As means for interfacing and joining structural modules, any of various suitable means may be used, including high strength fasteners, such as bolts which are passed through matching bolt holes in adjacent structural modules, e.g. the bolt holes 70 for bolts (not shown) for joining roof structural modules 12 and 14, shown in FIG. 3; bolt holes 72 for bolts (not shown) for joining floor structural modules 18 and 20, shown in FIG. 8; and bolt holes 74 for bolts (not shown) for joining adjacent sloping side panels 26 and 27, shown in FIG. 12 for structural module 27.

As a means of ingress and egress for allowing a person to enter and exit the structure, a sufficient open space is provided, in the side wall, which must be of adequate size to allow a person to pass through it, but should have an area which is only a small portion of the total surface area of the structure, to minimize the opportunity for debris penetration.

Additional details of structure are added to the preferred embodiment for aesthetic and other purposes outside the scope of the earthquake resistant functions of the invention. These include a dust cover 78 of decorative design, covering the interior face of roof module 14, shown in FIG. 3; decorative dust covers 80 on the interior faces of truss modules 42 and 44, as indicated in FIG. 15 for module 42; and use of a decorative design (not shown) printed or overlaid on the exterior surface of the exterior sheathing, to enhance the aesthetic appearance of the structure.

Some Possible Variations From the Preferred Embodiment

Those familiar with the art will appreciate that the invention may be employed in configurations other than the specific form disclosed above, without departing from the essential substance thereof. Without attempting to set out every possible variation from the preferred embodiment, some possible variations may usefully be indicated.

For example, and not by way of limitation, the roof 10 might be formed of different numbers of structural modules than the eight repeating structural modules 12 and 14 of the preferred embodiment, e.g. four larger modules instead of eight modules; the same variation could of course also be made for the floor 16.

Similarly different means could be used to attach the edges of adjacent structural modules together for assembling the overall structure, e.g. the use of adhesives of suitable strength.

The structural integrity preservation means and the anti-ballistic penetration means are each to be understood as means which act toward carrying out the stated functions, i.e. tending to preserve the structural integrity of the structure, and resisting ballistic penetration of the structure. But said means are not to be understood as being limited to means which can be completely successful in carrying out said functions, for a simple practical reason: Even if said functions are only partly served, this will at least reduce the risk of death or serious injury to a person within the structure.

The scope of the invention is defined by the following claims, including also all subject matter encompassed by the doctrine of equivalents as applicable to the claims.

I claim:

1. Earthquake resistant structure for containing within said structure a bed and for protection of a person in said bed against injury from earthquake damage to a building containing said structure and said bed, which injury may be caused by debris falling from said building during said earthquake, said structure having an outer wall with an exterior surface, said structure comprising:

(a) structural integrity preservation means, for tending to preserve structural integrity of said structure, comprising means to enhance the structural strength of said structure and means to allow said structure to respond to severe mechanical shocks and loading resulting from impacts of said debris, while maintaining structural integrity of said structure, said structural integrity preservation means having a plurality of structural modules, a plurality of which are adjacent to one another;

(b) anti-ballistic penetration means, comprising at least a major portion of said outer wall of said structure, to resist ballistic penetration of said structure by said debris fragments being thrust against said structure, said anti-ballistic penetration means having a plurality of structural modules, a plurality of which are adjacent to one another;

(c) interfacing and joining means, for interfacing and joining said structural modules of said structural integrity preservation means and said structural modules of said anti-ballistic penetration means, to form said structure;

(d) ingress and egress means, located in said wall of said structure, for allowing said person to enter and exit said structure, while also minimizing opportunity for said debris to enter said structure;

wherein said structural integrity preservation means comprises a geometric form for said structure of the form of a modified tetragonal anti-prism, comprising a square upper roof panel at the top of said structure, said roof panel having four corners and four sides; a flat square base panel at the bottom of said structure, having four corners and having an orientation rotated at least substantially 90 degrees with respect to the orientation of said roof panel; four vertical corner support structural members, each extending upward from one of said corners of said base panel, to a height which is appreciably less than the full height of said structure; and eight slanting structural members, two connecting each one of said corners of said roof panel to the tops of the two of said vertical corner support structural members closest to said corner of said roof panel.

2. Earthquake resistant structure for containing within said structure a bed and for protection of a person in said bed against injury from earthquake damage to a building containing said structure and said bed, which injury may be caused by debris falling from said building during said earthquake, said structure having an outer wall with an exterior surface, said structure comprising:

(a) structural integrity preservation means, for tending to preserve structural integrity of said structure, comprising means to enhance the structural strength of said structure and means to allow said structure to respond to severe mechanical shocks and loading resulting from impacts of said debris, while maintaining structural integrity of said structure, said structural integrity preservation means having a plurality of structural modules, a plurality of which are adjacent to one another;

(b) anti-ballistic penetration means, comprising at least a major portion of said outer wall of said structure, to resist ballistic penetration of said structure by said debris fragments being thrust against said structure, said anti-ballistic penetration means having a plurality of structural modules, a plurality of which are adjacent to one another;

(c) interfacing and joining means, for interfacing and joining said structural modules of said structural integrity preservation means and said structural modules of said anti-ballistic penetration means, to form said structure;

(d) ingress and egress means, located in said wall of said structure, for allowing said person to enter and exit said structure, while also minimizing opportunity for said debris to enter said structure;

wherein said structural integrity preservation means comprises a plurality of axially reinforced load bearing structural members.

3. Earthquake resistant structure for containing within said structure a bed and for protection of a person in said bed against injury from earthquake damage to a building containing said structure and said bed, which injury may be caused by debris falling from said building during said earthquake, said structure having an outer wall with an exterior surface, said structure comprising:

(a) structural integrity preservation means, for tending to preserve structural integrity of said structure, comprising means to enhance the structural strength of said structure and means to allow said structure to respond to severe mechanical shocks and loading resulting from impacts of said debris, while maintaining structural integrity of said structure, said structural integrity preservation means having a plurality of structural modules, a plurality of which are adjacent to one another;

(b) anti-ballistic penetration means, comprising at least a major portion of said outer wall of said structure, to resist ballistic penetration of said structure by said debris fragments being thrust against said structure, said anti-ballistic penetration means having a plurality of structural modules, a plurality of which are adjacent to one another;

(c) interfacing and joining means, for interfacing and joining said structural modules of said structural integrity preservation means and said structural modules of said anti-ballistic penetration means, to form said structure;

(d) ingress and egress means, located in said wall of said structure, for allowing said person to enter and exit said structure, while also minimizing opportunity for said debris to enter said structure;

wherein said structural integrity preservation means comprises a plurality of triangulated tensioned tow cables connecting a plurality of adjacent ones of said structural modules of said structural integrity preservation means and said anti-ballistic penetration means.

4. The structure of claim 1, wherein said structural integrity preservation means further comprises a plurality of axially reinforced load bearing structural members, with a plurality of said members being adjacent to one another.

5. The structure of claim 4, wherein said structural integrity preservation means further comprises a plurality of triangulated tensioned tow cables connecting a plurality of adjacent ones of said axially reinforced load bearing structural members.

6. The structure of claim 1, wherein said structural integrity preservation means further comprises shock absorbing means contained within each of said vertical corner support structural members extending upward from said corners of said bottom square, for absorbing compressive shocks received by said vertical corner support members.

7. The structure of claim 6, wherein said structural integrity preservation means further comprises a plurality of triangular configurations of said structural modules of said structural integrity preservation means and of said anti-ballistic penetration means.

8. The structure of claim 1, wherein said anti-ballistic penetration means is composed of composite materials.

9. The structure of claim 7, wherein said triangular structural modules of said anti-ballistic penetration means are composed of composite materials.

10. The structure of claim 8, wherein said composite materials are selected from the group consisting of KEVLAR composite synthetic material, SPECTRA composite synthetic material, carbon fibers, and tow bundles of parallel strands of high strength synthetic materials.

11. The structure of claim 1, wherein said upper square roof panel surface has a center point higher than the remainder of said roof panel, and wherein said roof panel slopes downward to said sides of said roof panel from said center point.

12. The structure of claim 1, wherein said anti-ballistic penetration means comprises a sheathing formed of high strength composite material, having a decorative design overlay, covering the major portion of said exterior surface of said structure.

13. The structure of claim 1, wherein said ingress and egress means comprises an opening in one side of said wall of said structure, just sufficient in size to allow said person to enter and exit said structure.

14. The structure of claim 1, wherein said interfacing and joining means comprises high strength fasteners.

15. The structure of claim 14, wherein said interfacing and joining means further comprises high strength adhesive material.

16. The structure of claim 1, wherein said four vertical corner support structural members each have a height at least substantially equal to half of the total height of said structure.

17. The structure of claim 9, wherein said triangular structural modules of said anti-ballistic penetration means have honeycomb cores of repeating hexagonal form.

18. The structure of claim 2, wherein said axially reinforced load bearing structural members have triangular cross sections.

19. The structure of claim 2, wherein said axially reinforced load bearing structural members have rectangular cross sections.

20. The structure of claim 2, wherein said axially reinforced load bearing structural members have circular cross sections.

* * * * *